US007281542B2

(12) United States Patent
Ko

(10) Patent No.: US 7,281,542 B2
(45) Date of Patent: Oct. 16, 2007

(54) POSITIONING STRUCTURE FOR UMBRELLA RUNNER

(76) Inventor: Chin-Sung Ko, No. 38, Din Nan Road, Ho Mei Town, Changhua Shien (TW)

( * ) Notice: Subject to any disclaimer, the term of this patent is extended or adjusted under 35 U.S.C. 154(b) by 335 days.

(21) Appl. No.: 10/833,168

(22) Filed: Apr. 28, 2004

(65) Prior Publication Data

US 2005/0241687 A1 Nov. 3, 2005

(51) Int. Cl.
*A45B 25/08* (2006.01)

(52) U.S. Cl. ..... 135/39

(58) Field of Classification Search ..... 135/28, 135/38, 39, 40, 41
See application file for complete search history.

(56) References Cited

U.S. PATENT DOCUMENTS 1,824,192 A * 9/1931 Bouma ..... 135/28
3,643,674 A * 2/1972 Granrath ..... 135/28
6,382,222 B1 * 5/2002 Ko ..... 135/41
6,758,229 B2 * 7/2004 Wang ..... 135/41
6,941,960 B2 * 9/2005 Huang ..... 135/41

FOREIGN PATENT DOCUMENTS

CH 621691 * 2/1981

* cited by examiner

*Primary Examiner*—David Dunn
*Assistant Examiner*—Noah Chandler Hawk
(74) *Attorney, Agent, or Firm*—Rosenberg, Klein & Lee

(57) ABSTRACT

An umbrella runner has two engaging slices respectively pivotally connected on two sides of the runner. A sleeve is displaceably disposed around the runner. An annular groove is provided on a top tube of the shaft of the umbrella. The sleeve can be moved upward and downward for pivoting the slices to position the runner and the umbrella in a stable open state.

3 Claims, 6 Drawing Sheets

POSITIONING STRUCTURE FOR UMBRELLA RUNNER

FIELD OF THE INVENTION

The present invention relates to an umbrella, which has an invented structure for positioning the runner in ease.

BACKGROUND OF THE INVENTION

A conventional umbrella is provided with an elastic bow in the shaft to position, its runner for maintaining the umbrella in opened state. It is known that the procedure to put the elastic bow into the shaft is very difficult and trouble. Moreover, a slot must be formed on the shaft for allowing top end of the elastic bow extending outward. This will decrease the strength of the shaft.

SUMMARY OF THE INVENTION

The present invention is to provide a positioning structure for runner of the umbrella, which provides a runner with engaging slices inside and a sleeve placed around the runner. And the runner can be stopped at right place for maintaining the umbrella in opened state very easily while the elastic bow is not necessary.

Now, accompanying with the following drawings, the character of the present invention will be described here and after.

DETAILED DESCRIPTION OF THE PREFERRED EMBODIMENT

Figure 1:
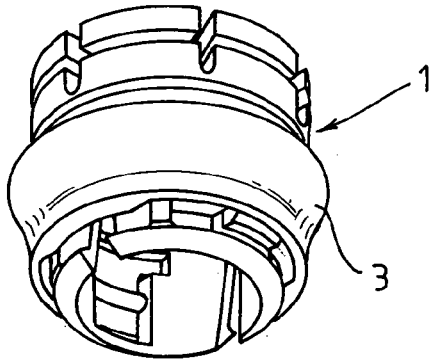
FIG. 1 is a perspective view showing a runner according to the present invention.
Figure 2:
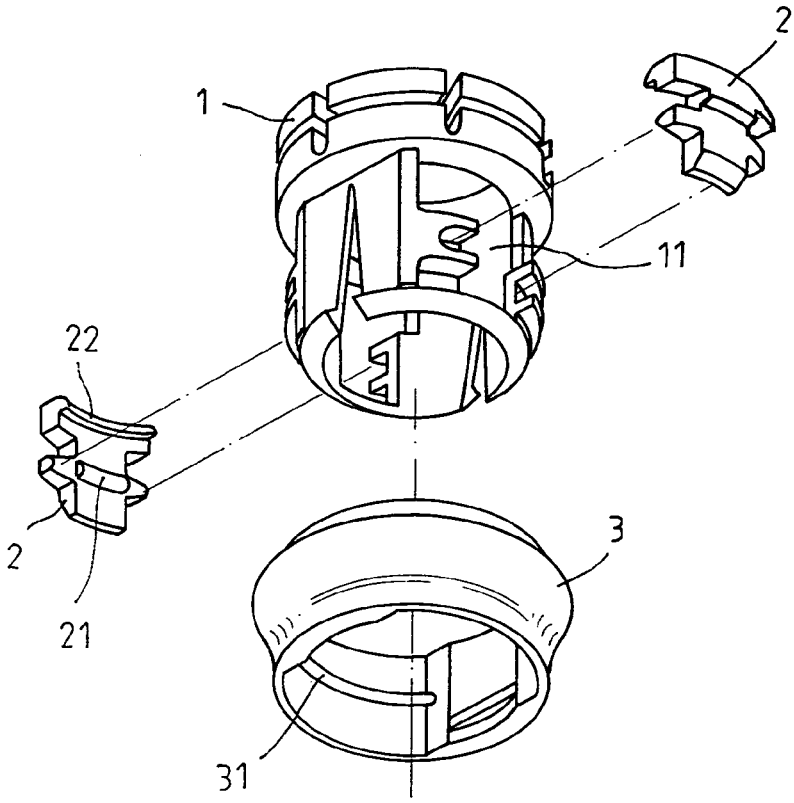
FIG. 2 is an exploded perspective view of FIG. 1.
Figure 3:
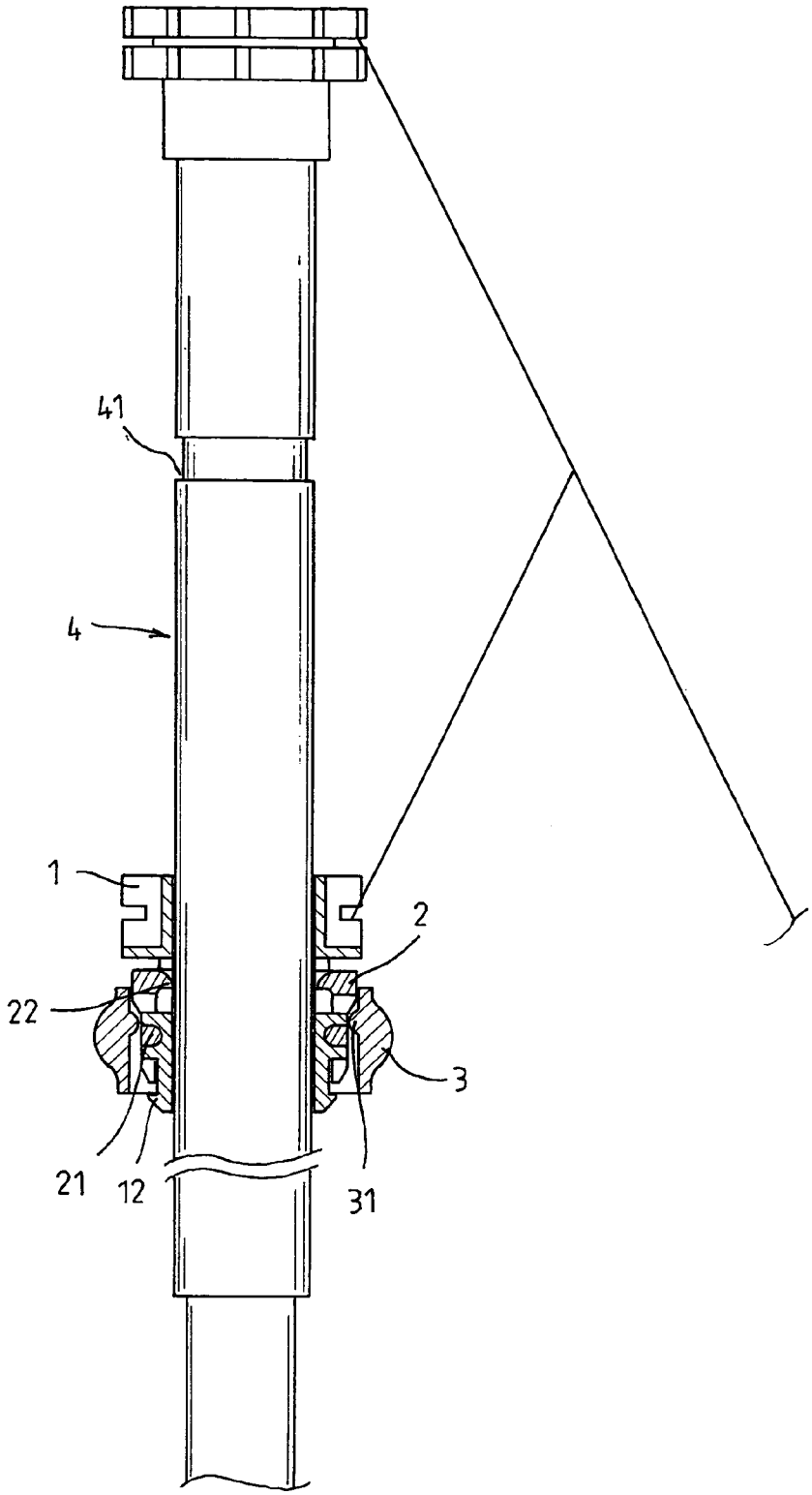
FIG. 3 is a plan view showing an umbrella with the runner according to the present invention.

Please referring to FIG. 1 to 4, the present invention is mainly used on an umbrella having a shaft (4) composed of multiple tubes wherein each upper tube is larger than each lower tube. A runner (1) is provided around the shaft (4), which has the top tube with an annular groove (41). The runner (1) has both sides with a groove (11) for engaging with an inner protrusion (21) of a respective engaging slice (2), which is then capable of swinging. Each respective engaging slice (2) has a pair of arms extending laterally therefrom which are received in corresponding recesses respectively disposed on a corresponding one of the grooves (11) of the runner (1).

Figure 4:
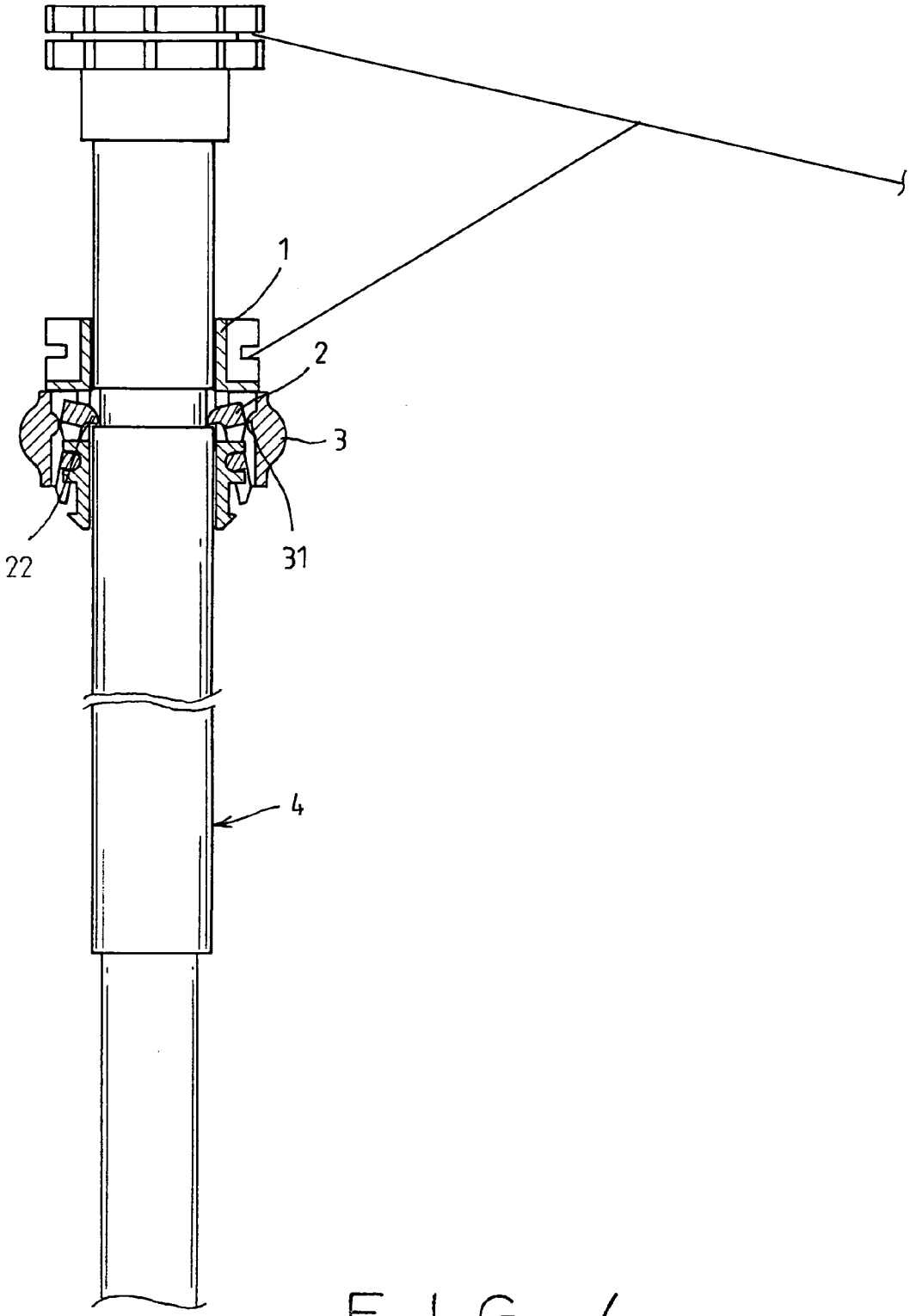
FIG. 4 is a plan view of FIG. 3 in opened state.

A sleeve (3) is placed around the runner (1) and is provided with an inner annular ring (31) to contact with the slices (2). The sleeve (3) is engaged with the runner (1) by bottom hook (12) that the sleeve (3) can only move a slight distance outside the runner (1). When the umbrella is opened, as shown in FIG. 4, the runner (1) is in the right place and the sleeve (3) can be moved upward to push top end of the slice (2) swinging inward by the inner ring (31).

The engaging end (22) of the slice (2) is then engaged with the groove (41) of the shaft (4) that positions the runner (1) in stable for keeping the umbrella being opened.

When to close the umbrella, the sleeve (3) is moved downward firstly to recover the slice (2) for releasing the engaging end (22) from the groove (41). Hence, the runner (1) can be moved down to close the umbrella.

Figure 5:
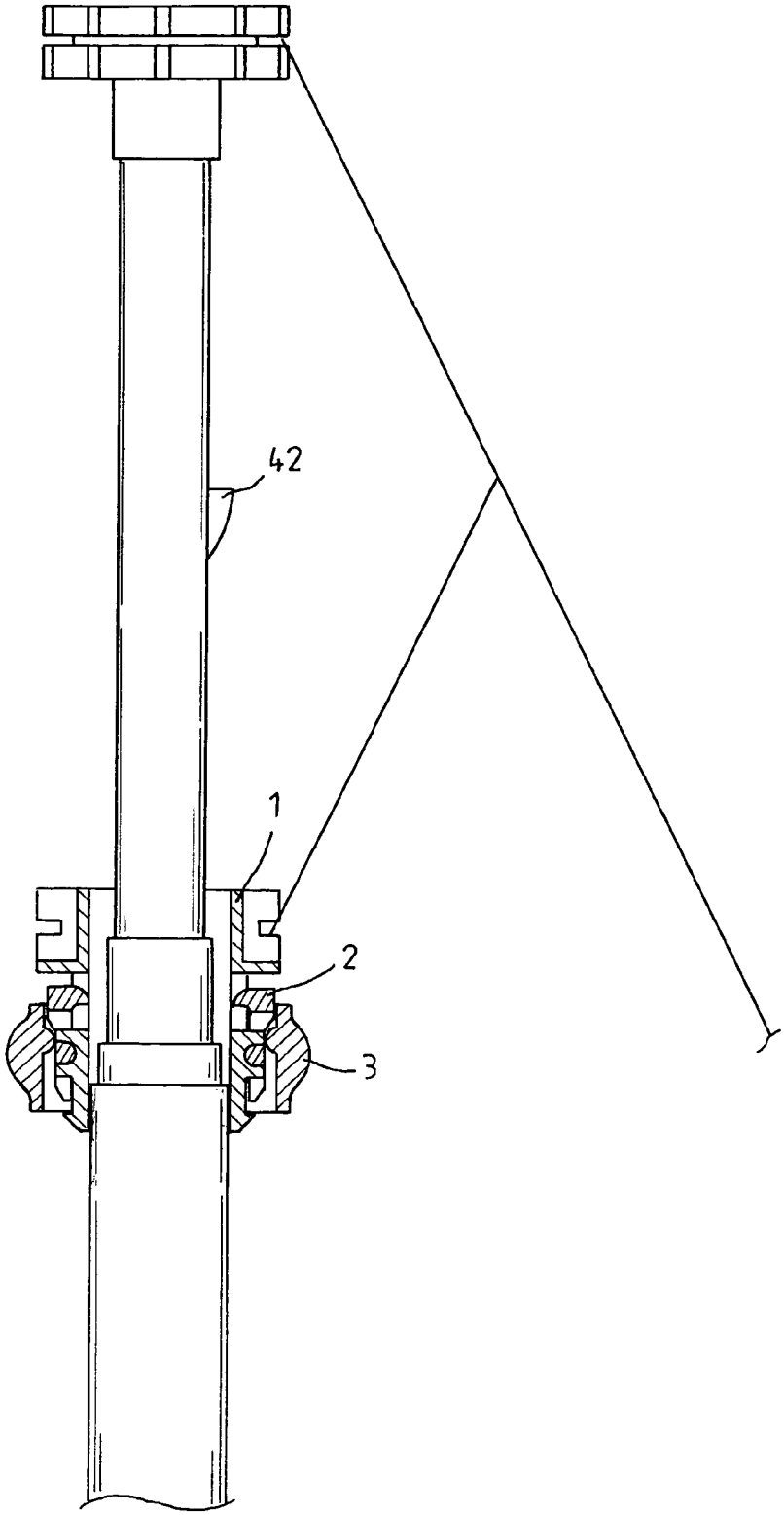
FIG. 5 is a plan view showing another embodiment according to the present invention.
Figure 6:
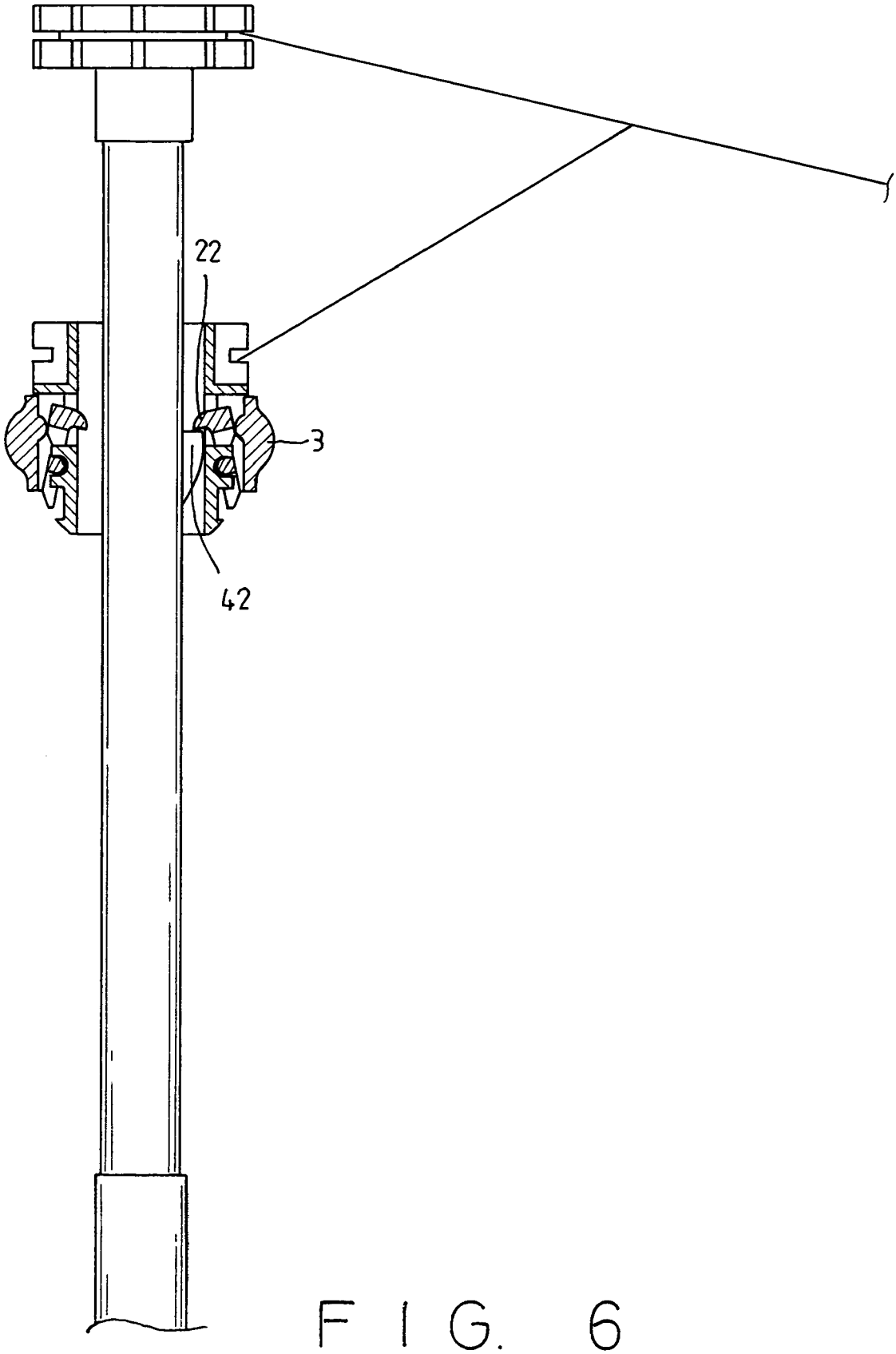
FIG. 6 is a plan view of FIG. 5 in opened state.
Figure 7:
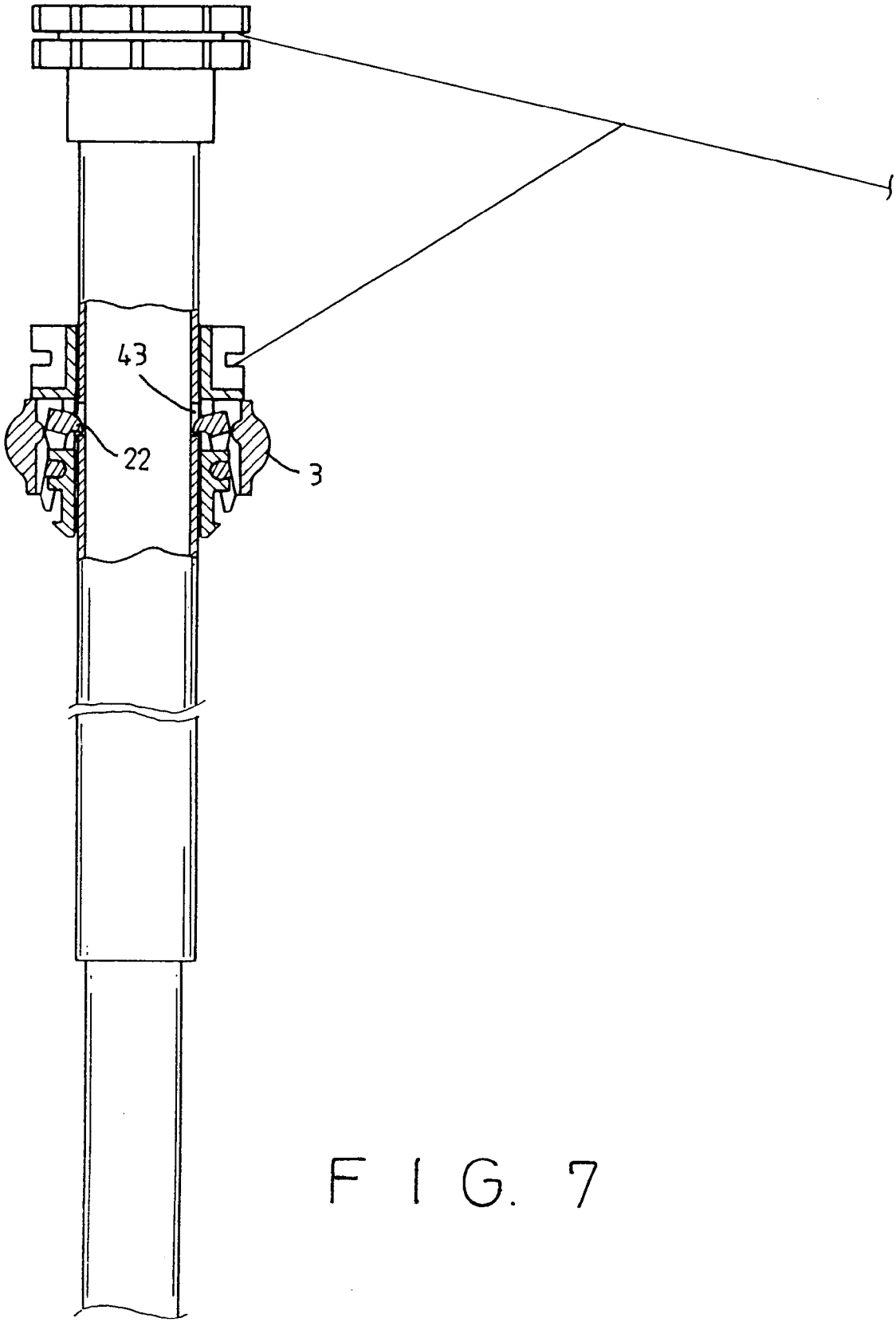
FIG. 7 is a plan view showing a further embodiment according to the present invention.

The runner (1) of the present invention can be used on a prior known umbrella having a shaft with multiple tubes, wherein each upper tube is smaller lower tube and top tube is provided with an elastic bow (42). As shown in FIG. 5 and 6, the engaging end (22) of the slice (2) can be engaged with the extended top end of the elastic bow (42) that keeps the runner (1) position for maintaining the umbrella in stable opened state. In another embodiment of FIG. 7, it shows that the shaft (4) is provided with two apertures (43) on both sides for positioning the engaging end (22) of the slice (2). This modified structure is also claimed in the present invention.

I claim:

1. A runner combined with an umbrella having a shaft with a groove formed adjacent to an upper end thereof, the runner being sleeved on the umbrella shaft for displacement thereon and having a pair of side grooves formed therein, the runner having two slices respectively pivotally disposed in the pair of side grooves, each of the slices having (a) a pair of arms extending laterally therefrom for receipt in corresponding recesses respectively disposed on opposing lateral sides of a corresponding one of the pair of side grooves to provide a pivotal coupling therewith, and (b) an upper engaging end, the runner including a sleeve slidably disposed on the runner, the sleeve having an annular ring extending from an inner surface thereof to contact the two slices, each slice being pivotally displaced about the pair of arms thereof for engaging the upper engaging end thereof in the groove of the shaft responsive to the sleeve being displaced upwardly to cam the slices with the annular ring of the sleeve and release the engagement responsive to downward displacement of the sleeve.

2. A runner combined with an umbrella having a shaft composed by multiple tubes, in which each upper tube is smaller than a respective lower tube and an elastic bow extending from one side of an uppermost tube, the runner being sleeved on the umbrella shaft for displacement thereon and having a pair of side grooves formed on two sides thereof, one of the side grooves being in correspondence with the side of the shaft having the elastic bow extending therefrom, the runner having two slices respectively pivotally disposed in the pair of side grooves, each of the slices having (a) a pair of arms extending laterally therefrom for receipt in corresponding recesses respectively disposed on opposing lateral sides of a corresponding one of the pair of side grooves to provide a pivotal coupling therewith, and (b) an upper engaging end, the runner including a sleeve slidably disposed on the runner, the sleeve having an annular ring extending from an inner surface thereof to contact the two slices, each slice being pivotally displaced about the pair of arms thereof for engaging the upper engaging end of one of the slices with the elastic bow extending from the shaft responsive to the sleeve being displaced upwardly to cam the slices with the annular ring of the sleeve and release the engagement responsive to downward displacement of the sleeve.

3. A runner combined with an umbrella having a shaft with a pair of apertures formed on two sides of the shaft, the runner being sleeved on the umbrella shaft for displacement thereon and having a pair of side grooves formed on two sides thereof in correspondence with the sides of the shaft having the apertures formed therein, the runner having two slices respectively pivotally disposed in the pair of side grooves, each of the slices having (a) a pair of arms extending laterally therefrom for receipt in corresponding recesses respectively disposed on opposing lateral sides of a corresponding one of the pair of side grooves to provide a pivotal coupling therewith, and (b) an upper engaging end, the runner including a sleeve slidably disposed on the runner, the sleeve having an annular ring extending from an inner surface thereof to contact the two slices, each slice being pivotally displaced about the pair of arms thereof for engaging the upper engaging end of each of the slices with a corresponding one of the apertures in the shaft responsive to the sleeve being displaced upwardly to cam the slices with the annular ring of the sleeve and release the engagement responsive to downward displacement of the sleeve.

* * * * *